US012082631B2

(12) United States Patent
Johnson

(10) Patent No.: US 12,082,631 B2
(45) Date of Patent: Sep. 10, 2024

(54) LOAD CARRYING ASSEMBLY WITH MODIFIED POUCH ATTACHMENT

(71) Applicant: Lineweight LLC, Brooklyn, NY (US)

(72) Inventor: Matthew Johnson, Milford, PA (US)

(73) Assignee: Lineweight LLC, Brooklyn, NY (US)

( * ) Notice: Subject to any disclaimer, the term of this patent is extended or adjusted under 35 U.S.C. 154(b) by 141 days.

(21) Appl. No.: 18/153,547

(22) Filed: Jan. 12, 2023

(65) Prior Publication Data

US 2023/0225428 A1 Jul. 20, 2023

Related U.S. Application Data

(60) Provisional application No. 63/299,694, filed on Jan. 14, 2022.

(51) Int. Cl.

| | |
|---|---|
| ***A41D 13/00*** | (2006.01) |
| ***A41D 1/04*** | (2006.01) |
| ***A45F 5/02*** | (2006.01) |
| ***F41H 1/02*** | (2006.01) |

(52) U.S. Cl.

CPC ..... *A41D 13/0012* (2013.01); *A41D 1/04* (2013.01); *A45F 5/022* (2013.01); *F41H 1/02* (2013.01)

(58) Field of Classification Search

CPC ..... A41D 13/0012; A41D 1/04; F41C 33/041; F41H 1/02; A45F 5/022

USPC ..... 224/230, 901.8, 901.4; 2/249, 250

See application file for complete search history.

(56) References Cited

U.S. PATENT DOCUMENTS

| | | | | | |
|---|---|---|---|---|---|
| 3,193,842 | A | * | 7/1965 | Bell | A41D 27/20 D2/857 |
| 4,022,361 | A | * | 5/1977 | Devlin | F41C 33/041 224/192 |
| 4,165,826 | A | * | 8/1979 | Chica | F41C 33/048 224/191 |
| 4,258,871 | A | * | 3/1981 | McMahon | F41C 33/0209 224/192 |
| 4,262,832 | A | * | 4/1981 | Perkins | F41C 33/0227 224/605 |
| 4,721,238 | A | * | 1/1988 | Shoemaker | F41C 33/0227 224/911 |
| 4,903,874 | A | * | 2/1990 | Shoemaker | F41C 33/046 D3/222 |
| 4,966,320 | A | * | 10/1990 | DeSantis | F41C 33/0209 224/931 |
| 5,263,618 | A | * | 11/1993 | Talavera | A45F 3/14 224/605 |
| 5,431,318 | A | | 7/1995 | Garcia | |
| 5,617,582 | A | | 4/1997 | Burwell | |

(Continued)

OTHER PUBLICATIONS

International Search Report mailed May 2, 2023 for PCT/US23/60529, 13 pp.

*Primary Examiner* — Justin M Larson

(74) *Attorney, Agent, or Firm* — Fox Rothschild LLP

(57) ABSTRACT

The present disclosure relates to a load carrying assembly, including: a vest having a front section, a rear section spaced rearwardly of the front section, and left and side sections extending between the front and rear sections, wherein the front section and/or the rear section includes an attachment pocket; and a pouch attachment has a flap extension fixed to a pouch section, wherein the flap extension has a fastener that is configured to securely attach to a corresponding fastener positioned inside the attachment pocket.

19 Claims, 5 Drawing Sheets

(56) References Cited

U.S. PATENT DOCUMENTS 5,683,022 A * 11/1997 Evans ..... A45F 5/02 224/672
5,692,237 A * 12/1997 Bennett ..... F41C 33/00 2/93
5,991,925 A * 11/1999 Wu ..... A41D 13/0012 224/931
6,405,376 B1 * 6/2002 Falk ..... A41D 31/102 2/102
8,032,951 B1 * 10/2011 Nestberg ..... A41D 27/20 2/69
8,069,540 B2 * 12/2011 Obiols ..... F16L 3/233 24/265 AL
8,225,976 B2 * 7/2012 Meunier ..... A45F 5/02 224/675
8,522,367 B2 * 9/2013 French ..... A45F 5/022 2/250
8,776,262 B2 7/2014 Blauer et al.
8,904,564 B2 * 12/2014 Laycock ..... A41D 19/0041 2/93
9,441,916 B2 9/2016 Seuk
9,846,012 B2 * 12/2017 Crye ..... A42B 3/105
10,010,160 B1 7/2018 Ostrowski et al.
10,066,901 B2 * 9/2018 Dahl ..... F41C 33/0236
10,288,384 B2 5/2019 Kinnings
11,079,203 B2 * 8/2021 Becker ..... A41D 13/0012
11,197,520 B2 * 12/2021 Takakuwa ..... A44B 99/00
D1,021,332 S * 4/2024 Dammaschke ..... D2/829
2003/0205595 A1 * 11/2003 Young ..... F41C 33/0218 224/230
2004/0245304 A1 12/2004 Cragg
2009/0282595 A1 11/2009 Branson et al.
2012/0132066 A1 5/2012 Seuk
2021/0085064 A1 * 3/2021 Khalsa ..... H04M 1/04
2023/0200462 A1 * 6/2023 Dorsey, Jr. ..... A41D 27/20 2/250
2023/0225428 A1 * 7/2023 Johnson ..... F41H 1/02 2/102

* cited by examiner

LOAD CARRYING ASSEMBLY WITH MODIFIED POUCH ATTACHMENT

CROSS-REFERENCE TO RELATED APPLICATION

This application claims the benefit of priority to U.S. Provisional Patent Appl. No. 63/299,694 filed Jan. 14, 2022, the disclosure of which is hereby incorporated by reference in its entirety.

FIELD

The present disclosure generally relates to a pouch attachment for ergonomic, secure attachment to a load carrying assembly, such as a ballistic vest.

BACKGROUND

Load carrying assemblies are commonly used by members of the military and law enforcement to secure both protective body armor and desired items (e.g., weapons, radios, flashlights, ammunition, maps, and other accessories) to the user wearing the load carrying assembly. See, e.g., U.S. Pat. No. 9,603,393. Often, there is significant weight distributed on the assembly, which makes it difficult to quickly doff and don the load carrying assembly under urgent conditions, such as when a user needs to rapidly remove the assembly to board a helicopter. In particular, when multiple and/or heavy accessories are attached to the side portions (e.g., cummerbund) of a load carrying assembly, such weighty accessories will hang down from the assembly as it is removed, making the assembly unwieldy to carry and maneuver and potentially causing accessories to be damaged if they hit or are dragged along the ground. Attachments hanging from the side portions of a removed assembly can also get snagged on other objects in the field, causing further delays and difficulties that can put the user at risk. Thus, there is a need for an improved system for ergonomically attaching and securing accessories to the side of a load carrying assembly.

SUMMARY

The present disclosure relates generally to a load carrying assembly including a vest, and a pouch attachment fastened to a front or rear section of the vest such that the pouch attachment is securely positioned along a side section of the vest adjacent an edge of the front or rear section.

In one aspect, the disclosed technology relates to a load carrying assembly, including: a vest including a front section, a rear section spaced rearwardly of the front section, and a left side section and a right side section that each extend between the front section and the rear section, wherein the front section and/or the rear section includes an attachment pocket, a fastener being positioned inside the attachment pocket; and a pouch attachment including a pouch section configured to hold an accessory, and a flap extension fixed to the pouch section and including another fastener, wherein the attachment pocket is configured to receive at least a portion of the flap extension, and the fastener of the flap extension is configured to securely attach to the fastener of the vest. In some embodiments, the vest is configured to be worn on a torso of a user; and at least one of the left side section and the right side section of the vest is configured such that the pouch section is positioned between the at least one of the left side section and the right side section of the vest and is held against the torso of the user when the load carrying assembly is worn by the user and the at least a portion of the flap extension is positioned inside the attachment pocket. In some embodiments, the assembly includes an attachment pocket having an opening provided at a left side of the front and/or rear section of the vest. In some embodiments, the assembly includes an attachment pocket having an opening provided at a right side of the front and/or rear section of the vest.

In some embodiments, the fastener of the flap extension and the fastener of the vest include hook and loop. In some embodiments, the flap extension has a length of about 2 inches to about 16 inches. In some embodiments, the flap extension has a width of about 4 inches to about 18 inches. In some embodiments, the front section of the vest further includes an armor pocket, and the attachment pocket is configured to be positioned between the armor pocket and a torso of a user when the load carrying assembly is worn by the user. In some embodiments, the left side section and the right side section include a cummerbund configured to attach to one or more accessories. In some embodiments, a rear-facing surface of an inside portion of the attachment pocket includes a fastener that aligns with and is configured to be secured to a corresponding fastener on a front-facing surface of an inside portion of the attachment pocket. In some embodiments, the fastener provided on the flap extension occupies an area that is at least 30% of the total area of the flap extension. In some embodiments, the width or length of the fastener provided on the flap extension is at least 75% of the full width or length, respectively, of the flap extension.

In another aspect, the disclosed technology relates to a vest including a front section, a rear section spaced rearwardly of the front section, and a left side section and a right side section that each extend between the front section and the rear section, wherein a side of the front section and/or a side of the rear section is fixed to a flap extension including a fastener; and a pouch attachment including a pouch section configured to hold an accessory, wherein the pouch attachment includes an attachment pocket and another fastener positioned inside the attachment pocket; wherein the attachment pocket is configured to receive at least a portion of the flap extension, and the fastener of the flap extension is configured to securely attach to the fastener of the vest. In some embodiments, the fastener of the flap extension and the fastener of the attachment pocket comprise hook and loop. In some embodiments, the flap extension has a length of about 2 inches to about 16 inches. In some embodiments, the flap extension has a width of about 4 inches to about 18 inches. In some embodiments, the left side section and the right side section comprise a cummerbund configured to attach to one or more accessories. In some embodiments, the fastener provided on the flap extension occupies an area that is at least 30% of the total area of the flap extension. In some embodiments, a width or length of the fastener provided on the flap extension extends at least 75% of the full width or length, respectively, of the flap extension.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated herein and constitute part of this specification, are illustrative of particular embodiments of the present disclosure and do not limit the scope of the present disclosure. The drawings are not to scale and are intended for use in conjunction with the explanations in the following detailed description.

DETAILED DESCRIPTION

Figure 3:
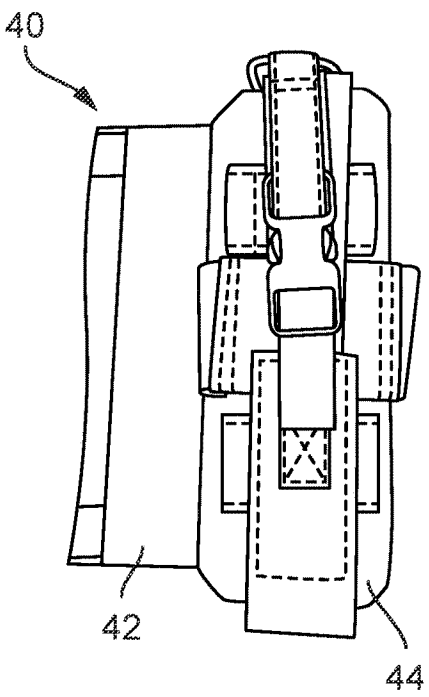
FIG. 3 shows an example of a pouch attachment with a flap extension provided with loop fastener.

The following discussion omits or only briefly describes conventional features of the disclosed technology that are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

The devices of the present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. All spatial references, such as, for example, proximal, distal, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior."

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

The disclosed technology generally relates to a load carrying assembly that includes a vest and a pouch attachment. The vest may include a front section, a rear section, left and right side sections, and shoulder straps. The rear section is spaced rearwardly of the front section, and the left and right side sections extend between the front and rear sections. In some embodiments, all or a portion of the rear-facing surface of the front section has approximately the same maximum length and/or maximum width as all or a portion of a front-facing surface of the back section. The front and rear sections may include pockets that hold hard or soft ballistic armor plates. While the disclosed technology is generally described with reference to a vest in the form of a plate carrier having a front section and a rear section, the disclosed technology may be applied to other types of vests including but not limited to vests without armor plates or vests with a single section (e.g., a "chest rig"). The side sections may be provided in the form of a waist-encircling cummerbund. The cummerbund or side sections can have a variety of styles and structures. For example, the cummerbund or side sections may be configured with interior pockets configured to hold hard or soft ballistic armor plates. Alternatively, the cummerbund or side sections may be in the form of a panel with webbing or a skeletal frame, either of which can be attached to one or more accessories using a Modular Lightweight Load-carrying Equipment (MOLLE) system, Pouch Attachment Ladder System (PALS), or other suitable webbing system or attachment mechanism. In some embodiments, conventional pouch attachments that do not include a flap extension may also be attached to the vest using conventional methods, such as MOLLE or PALS. Each side section of the vest has a shoulder opening that allows the shoulder straps of the vest to be transferred to the shoulders of a user donning the vest. The cummerbund may be provided with an internal stiffening element, including but not limited to a material comprising soft or hard armor. The cummerbund includes a buckle or attachable portion that connects the cummerbund to the front section of the vest. The cummerbund is adjustable to securely engage the waist of a wearer at a desired height.

In some embodiments, the front section and/or rear section of the vest includes a vest attachment pocket located on the interior side of the vest. For vests that include a pocket in the front or rear section configured to receive and hold ballistic armor (an "armor pocket"), the above-mentioned vest attachment pocket may be provided as an additional pocket positioned within the vest, behind the armor pocket (between the armor pocket and the user) or in front of the armor pocket (between the armor pocket and the front-facing surface of the front section). The vest attachment pocket is configured to receive a flap extension of an embodiment of the pouch attachment that is referred to herein as a "flapped pouch attachment." The flap extension extends into the vest attachment pocket and is firmly secured therein. In another embodiment, the pouch attachment includes a pouch attachment pocket referred to herein as a "pocketed pouch attachment," wherein the pouch attachment pocket is configured to receive a flap extension fixed to the front section and/or rear section of the vest. One or more features of the flap extension and corresponding pocket (i.e., vest attachment pocket or pouch attachment pocket) of the load carrying assembly provided herein are generally applicable to one or more of the disclosed embodiments. The flapped pouch attachment embodiment is further described as a representative example of the pouch attachment.

To attach the pouch attachment to the vest, the flap extension is inserted into the attachment pocket and fasteners (including, e.g., fastening materials such as hook and loop) are utilized to tightly secure the pouch attachment in position. For instance, if the fastener is hook and loop material, the flap extension is inserted by hand into the attachment pocket and then pressed in place—e.g., when attaching a flapped pouch attachment, by pressing on the rear wall of the attachment pocket, which also serves as the rear wall of the front section of the vest that will contact a user's torso when the load carrying assembly is worn by the user. In general, to achieve the desired secure attachment, the flap extension is inserted such that all or substantially all of the flap extension is inside the attachment pocket. The fasteners then secure the flap extension to the attachment pocket interior.

Fasteners may also provide added security by closing the portions of the attachment pocket that are above and/or below the flap extension. For example, strips of hook and loop material at the opening of the pocket, along the front- and rear-facing outer edges, may be secured together above and/or below an inserted flap extension. In some embodiments, the attachment pocket has a fastener or closure system (e.g., hook and loop, zipper, snaps, etc.) configured to keep the attachment pocket closed. In some embodiments, the attachment pocket closure system or fastener is different from the fastener used for securing the flap extension to the interior of the attachment pocket.

A variety of fasteners can be suitably used to secure the flap extension inside the attachment pocket, including but not limited to hook and loop (wherein the hook fastener can be provided inside the attachment pocket and the loop fastener can be provided on the flap extension, or vice versa), snaps, buttons, zippers, and the like. In some embodiments, the fastener is provided on both a portion of the flap extension and the inside of the attachment pocket. Suitable non-limiting examples of fasteners include: a section of hook material attached directly or indirectly to the attachment pocket interior and an aligned strip of loop material attached directly or indirectly to the flap extension, or vice versa; a strip of zipper teeth attached directly or indirectly to the attachment pocket interior and an aligned strip of mating zipper teeth attached directly or indirectly to the flap extension, or vice versa; and a series of snap studs attached directly or indirectly to the attachment pocket interior and an aligned series of snap sockets attached directly or indirectly to the flap extension, or vice versa.

In some embodiments, the attachment pocket itself may include fasteners to close the pocket when, for example, no pouch attachment is installed within the pocket. Any one of a variety of suitable fasteners may be used to close the attachment pocket, including but not limited to hook and loop, snaps, buttons, zippers, and the like. In one embodiment, a rear-facing surface of an inside portion of the attachment pocket comprises a fastener that aligns with and is configured to be secured to a corresponding fastener on a front-facing surface of an inside portion of the attachment pocket. Additionally, in some embodiments when a pouch attachment is installed within the pocket, a portion of the pocket opening may be closed above and/or below the flap extension by any such suitable fastener. In some embodiments, the corresponding inside portions of the attachment pocket may have fasteners that do not extend the full length of the attachment pocket opening.

As used herein, a "width" is measured in a horizontal direction, for example, generally parallel to the ground when a user is wearing the vest. By contrast, a "length" is measured in a vertical direction (e.g., parallel to the height of the user wearing the vest and generally perpendicular to the ground).

In some embodiments, one or more fasteners may be provided in a strip having a width of about 0.5 inches to about 6 inches, such as about 1 inch to about 4.5 inches, about 1.5 inches to about 3 inches, or about 1 inch to about 2.5 inches; and having a length of about 1 inch to about 15 inches, such as about 2 inches to about 12 inches, or about 5 inches to about 10 inches. In some embodiments, one or both fasteners may be provided in a strip having a width of about 3 inches to about 17 inches, such as about 5 inches to about 15 inches, or about 6 inches to about 12 inches; and having a length of about 0.5 inches to about 4 inches, such as about 1 inch to about 3.5 inches, about 1 inch to about 3 inches, or about 1 inch to about 2.5 inches. In some embodiments, one or more fasteners may occupy a total area of about 5 square inches to about 270 square inches, such as about 20 square inches to about 220 square inches, or about 60 square inches to about 180 square inches.

In some embodiments, a fastener provided on the flap extension occupies an area that is at least 30%, at least 40%, at least 50%, at least 60%, at least 70%, at least 80%, or at least 90% of the total area of the flap extension. When the fastener comprises multiple parts (e.g., 1, 2, 3, 4, 5, or more snaps, 1, 2, 3, 4, 5, or more buttons, etc.), the area occupied by the fastener is the total area defined by the parts positioned furthermost from each other. In some embodiments, the width of a fastener provided on the flap extension is at least 75% (e.g., at least 80%, at least 85%, or at least 90%) of the full width of the flap extension. In some embodiments, the length of a fastener provided on the flap extension is at least 75% (e.g., at least 80%, at least 85%, or at least 90%) of the full length of the flap extension. In some embodiments, the fastener is set back from the outer perimeter edge of the flap extension. In some embodiments, the fastener positioned within the attachment pocket interior occupies an area that is greater than the area occupied by the corresponding fastener positioned on the flap extension.

In some embodiments, a fastener provided on the flap extension (e.g., provided in a single piece) has a width of about 3.5 inches to about 17.5 inches, such as about 4 inches to about 14 inches, or about 6 inches to about 12 inches. In some embodiments, a fastener provided on the flap extension (e.g., provided in a single piece) has a length of about 1.5 inches to about 15.5 inches, such as about 3 inches to about 12 inches, or about 5 inches to about 10 inches.

In general, the total area of the flap extension is larger than the total area covered by one or more fasteners. In some embodiments, the flap extension has a width of about 1 inch to about 10 inches, about 1.5 inches to about 7 inches. In some embodiments, the flap extension has a length of about 1 inch to about 12 inches, such as about 2 inches to about 10 inches, or about 3 inches to about 8 inches. In some embodiments, the flap extension is permanently fixed in place—e.g., securely sewn to the pouch attachment or to the vest, as appropriate. In some embodiments, the fastener provided on the flap extension does not fully cover the flap extension. For instance, an outermost portion of the flap extension (e.g., an outer portion of the flap extension having a width of about 0.5 inch to about 3 inches, such as about 1 inch to about 2 inches) may be free of any fastener.

In general, the width of the attachment pocket is greater than the width of the flap extension. In some embodiments, the width of the attachment pocket is about 1 inch to about 16 inches, such as about 2 inches to about 14 inches, or about 4 inches to about 12 inches. In general, the length of the attachment pocket is greater than the length of the flap extension. In some embodiments, the length of the attachment pocket is about 2 inches to about 14 inches, such as about 3 inches to about 12 inches, or about 5 inches to about 10 inches.

In some embodiments, when the attachment pocket is provided in the front section of the vest, corresponding fasteners are provided on the front-facing surface of the flap extension and the rear-facing surface of the attachment pocket interior. In some such embodiments, fasteners may additionally or alternatively be provided on the rear-facing surface of the flap extension and the front-facing surface of the attachment pocket interior. Likewise, when the attachment pocket is provided in the rear section of the vest, corresponding fasteners may be provided on the rear-facing surface of the flap extension and the front-facing surface of the attachment pocket interior. In some such embodiments, fasteners may additionally or alternatively be provided on the front-facing surface of the flap extension and the rear-facing surface of the attachment pocket interior.

The pouch attachment also includes a pouch section, with an interior portion configured to receive an accessory. The dimensions and structure of the pouch section can vary as appropriate to hold the desired accessory. For example, the pouch section can be configured to hold one or more accessories including a firearm magazine, an electronic (such as a radio or GPS unit), a bottle, light, medical kit, tool (such as a knife or multitool), firearm suppressor, or other suitably sized item.

As described herein, when the pouch attachment is attached to the front (or rear) section of the vest, the weight of any accessory contained within the pouch section is distributed toward the front (or rear) section of the vest. Consequently, when the side section or cummerbund is released so that the user can remove the load carrying assembly, the modified pouch attachment will remain attached to the front (or rear) section of the vest and will not hang down from the cummerbund. This provides a significant ergonomic advantage that enables the load carrying assembly to be more easily maneuvered when removed, and also protects the accessory from excess jostling or potential damage.

In addition to being attached to the front (or rear) section of the vest, the modified pouch attachment may optionally be attached to the cummerbund or side section as well—e.g., using the MOLLE or PALS system—to further secure the modified pouch attachment in place.

Advantageously, the modified pouch attachment may be positioned on the interior of the cummerbund or side section, allowing the accessory to be held closer to the user's body. In some embodiments, the load carrying assembly includes one, two, three, or four modified pouch attachments attached to the left and/or right sides of the front and/or rear sections of the vest. For instance, the vest of the load carrying assembly includes one or more attachment pockets positioned in the left side of the front section, the right side of the front section, the left side of the rear section, or the right side of the rear side. In one embodiment, the vest includes at least one of: a first attachment pocket provided at a left side of the front section of the vest, a second attachment pocket provided at a right side of the front section of the vest, a third attachment pocket provided at a left side of the rear section of the vest, and a fourth attachment pocket provided at a right side of the rear section of the vest.

In some embodiments, the vest having an attachment pocket may be used without a pouch attachment. For example, a user could store items or accessories directly inside one or more attachment pockets. In another example, padding elements or padding material could be inserted, optionally fixed, inside one or more attachment pockets to provide added comfort to the wearer of the load carrying assembly.

In some embodiments, the flap extension includes a rigid core substantially covered or fully covered by a substrate (e.g., fabric or other durable material) to which the fastener is secured. In some embodiments, the load carrying assembly includes a stiffener element to provide further rigidity when a heavier accessory is present in the pouch section. For example, the stiffener element may be fixed to or integrally formed with the hinge located between the flap extension and pouch section.

Non-limiting embodiments of the present disclosure are further described below with reference to the figures.

Figure 2:
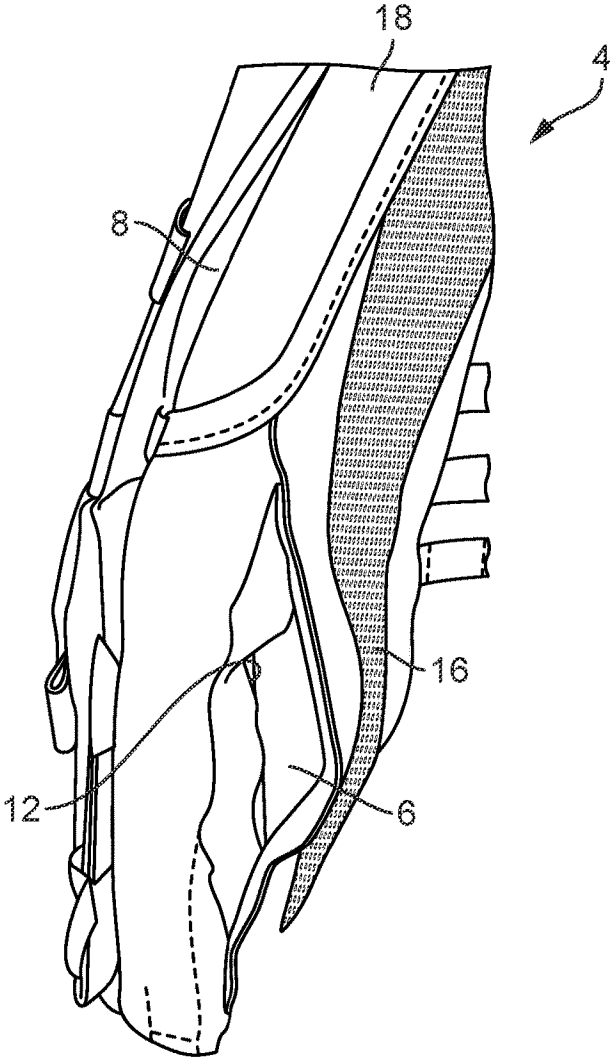
FIG. 2 shows an example of a front section of a vest with an open attachment pocket.
Figure 1:
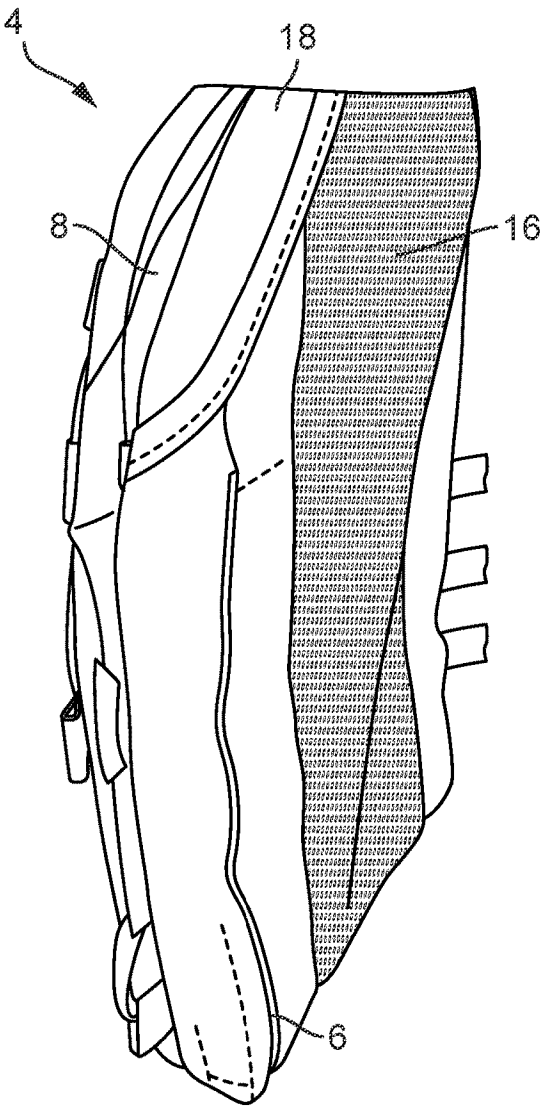
FIG. 1 shows an example of a front section of a vest with a closed attachment pocket.

As shown in the figures, a load carrying assembly 10 includes a vest 2 and a pouch attachment 40. The vest 2 has a front section 4. As shown in FIG. 1, the front section 4 includes an attachment pocket 6, depicted in the closed position without the pouch attachment 40 installed. In FIG. 1, the attachment pocket 6 is closed by a fastener, shown as aligned strips of hook and loop material. FIG. 2 shows the front section 4 of FIG. 1 with the attachment pocket 6 depicted in the open position, allowing the aligned strips of hook and loop material to be visible. Additionally, FIG. 2 shows hook material on the rear-facing surface of the inside of the attachment pocket 6. Attachment pocket 6 also includes a rear wall 16. Rear wall 16 can include a fastener (e.g., loop material) corresponding to the fastener (i.e, the hook material) on rear-facing surface 12 to close attachment pocket 6 when a pouch attachment is not connected to the vest. A ballistic plate 18 is provided inside an armor pocket 8 of the front section 4 of vest 2.

The opposite end of the attachment pocket 6 may be open or closed. For instance, while FIG. 1 shows a left side of a front section with an attachment pocket 6, the right side of the front section may be configured to have the same or similar attachment pocket 6 or may be configured without an attachment pocket. Similarly, the left and right sides of the rear section of the vest may both be configured to have attachment pockets, or only one or the other may be configured to have an attachment pocket. In some embodiments where an attachment pocket 6 is provided on both the left and right sides of front (and/or rear) section of the vest, the attachment pocket 6 defines an open passageway such that the overall width (depth) of the pocket is approximately the same as the width of the rear-facing interior wall of the front (and/or rear) section. In other embodiments, the attachment pocket 6 may have a finite width (depth) as described above.

FIG. 3 shows the pouch attachment 40 with a flap extension 42 and pouch section 44. As depicted, the flap extension 42 is provided with a strip of loop material that extends approximately the full length of the flap extension 42, but that does not extend the full width of the flap extension 42. The pouch section 44 includes a buckle to secure an accessory within the interior of the pouch section 44. The pouch section 44 may be configured to remain partially open on the sides and/or top (as depicted in FIG. 3) or may be configured to be fully closable (e.g., by a zipper, as depicted in pouch section 44*b* shown in FIG. 9).

Figure 4:
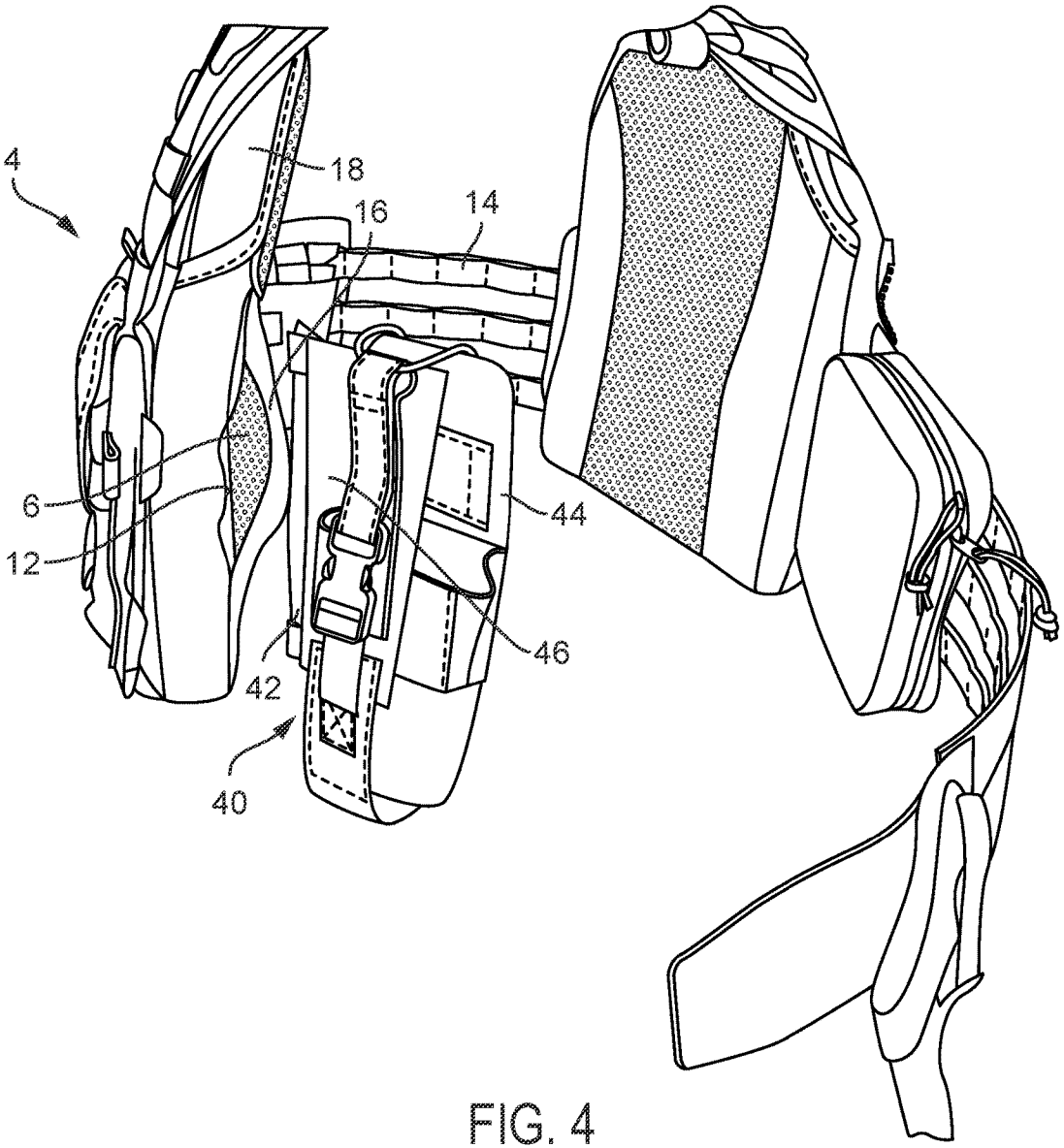
FIG. 4 shows an example of a portion of a load carrying assembly including a pouch attachment with a flap extension and the left side of a front section of a vest with an open attachment pocket and configured to securely receive the flap extension.

As shown in FIG. 4, attachment pocket 6 of front section 4 of vest 2 is open, and a rear wall 16 of the attachment pocket 6 may be constructed of a mesh or otherwise breathable or lightweight material. In the depicted embodiment, a rear-facing surface 12 of the inside of attachment pocket 6 includes fastener material that would align with fastener material on the front-facing surface 46 of the flap extension 42 of the pouch attachment 40. FIG. 4 also shows a right side section of cummerbund 14 depicted as a series of three evenly spaced, horizontal, parallel straps to which accessories, including but not limited to another pouch attachment 40 or a standard pouch attachment, may be attached.

Figure 5:
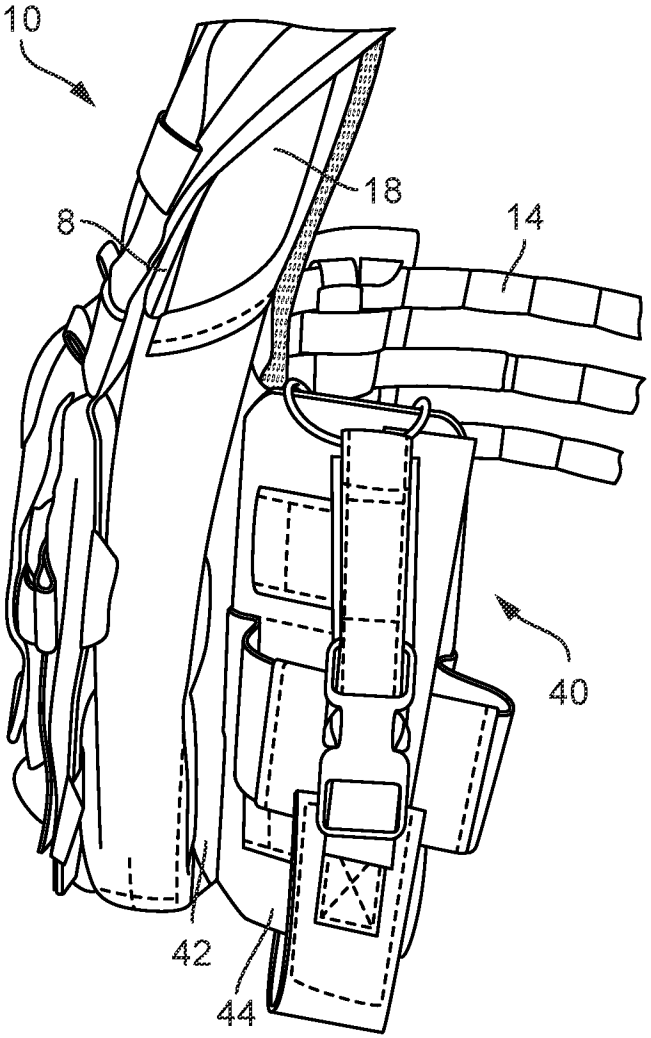
FIG. 5 shows an example of a pouch attachment with a flap extension inserted into the attachment pocket of the left side of a front section of a vest, wherein the pouch section is angled from the flap extension.

FIG. 5 shows a portion of the load carrying assembly 10 with pouch attachment 40 attached to the left side of the front section 4 of vest 2. The innermost portion of flap extension 42 adjacent the pouch section 44 is visible, whereas the majority of flap extension 42 is positioned inside of attachment pocket 6. As depicted, the total vertical length of attachment pocket 6 is greater than the total vertical length of flap extension 42. Making the total vertical length of attachment pocket 6 is greater than the total vertical length of flap extension 42 can aid in attachment of the pouch to vest 2 by making it easier to insert flap extension 42 into attachment pocket 6. The free end of the left side of the cummerbund (not shown) is detached from the left side of front section 4, and the pouch attachment 40 is directly attached to the front section 4 of vest 2. While depicted as a single piece, in some embodiments, the flap extension 42 could be separated into multiple flap extensions. For example, rather than a single flap extension, the pouch attachment could include two or more flap extensions. In some embodiments, the width of each of the multiple flap extensions can be greater than its individual vertical length.

In FIG. 5, the pouch section 44 and flap extension 42 are shown as being angled in relation to each other (approximately in an L-shape) in a manner that simulates the positioning of the pouch attachment 40 around the torso of a user who would wear the load carrying assembly 10. Hence, the flap extension 42 and pouch section 44 may be connected by a seam that acts, in effect, as a hinge, allowing the pouch attachment 40 to bend around the torso of a wearer.

Figure 6:
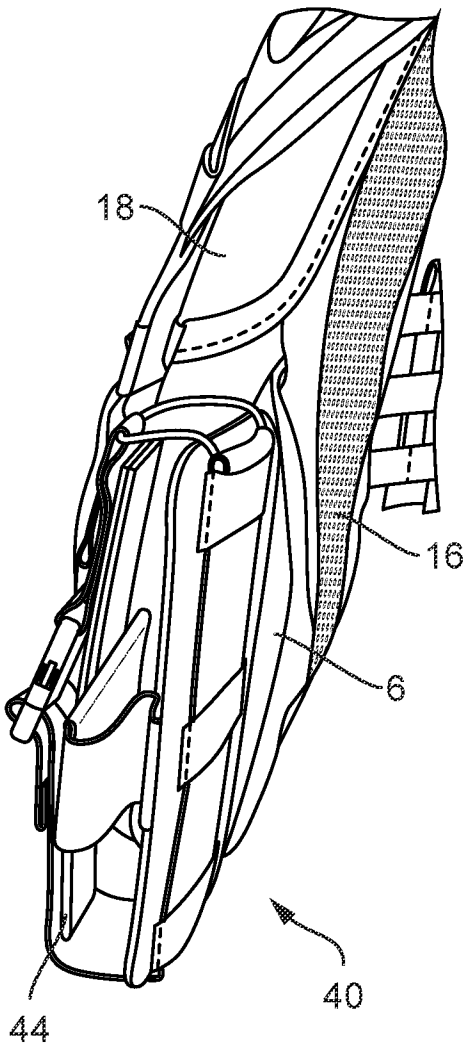
FIG. 6 shows an example of a pouch attachment with a flap extension inserted into the attachment pocket of the left side of a front section of a vest, wherein the pouch section is aligned with the flap extension.

The seam hinge can permit a wide range of angles, as desired to achieve a comfortable fit—e.g., from approximately 0 degrees as shown in FIG. 6 to approximately 90 degrees as shown in FIG. 5 or more, such as about 0 to about 135 degrees. In some embodiments, such as when the pouch attachment 40 is not attached to the vest 2, the seam hinge is flexible enough for a user to fold the flap extension 42 against the pouch section 44 in a closed configuration by squeezing the two parts together, but is rigid enough to regain an open configuration when released. In some embodiments, the flap extension 42 is substantially rigid so that it maintains its shape as it is inserted into attachment pocket 6. FIG. 6 shows the pouch section 44 and flap extension 42 in a straight configuration, before the pouch section 44 is bent towards a user's torso when the cummerbund 14 is connected to the front section 4.

Figure 7:
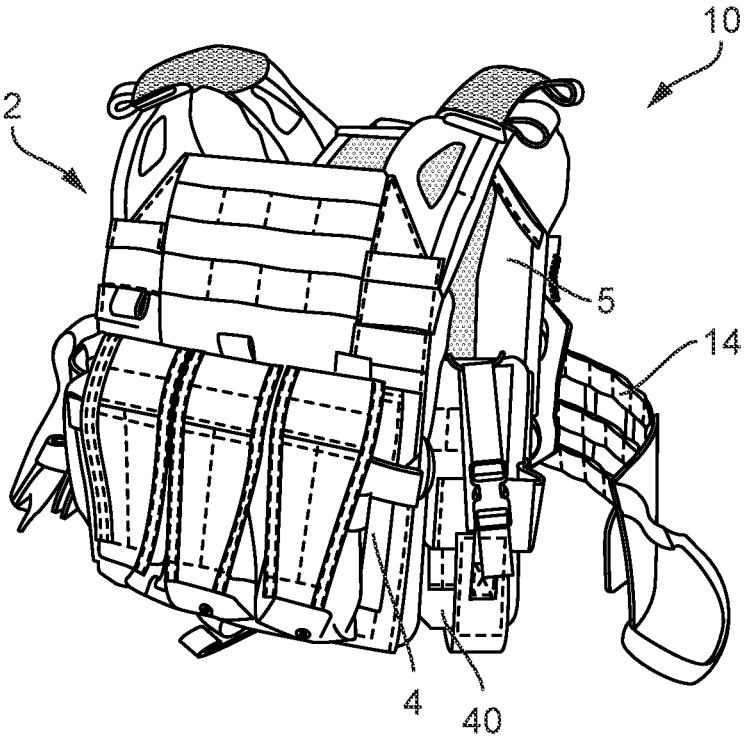
FIG. 7 shows an example of a load carrying assembly with a pouch attachment securely attached to the left side of a front section of the vest.
Figure 8:
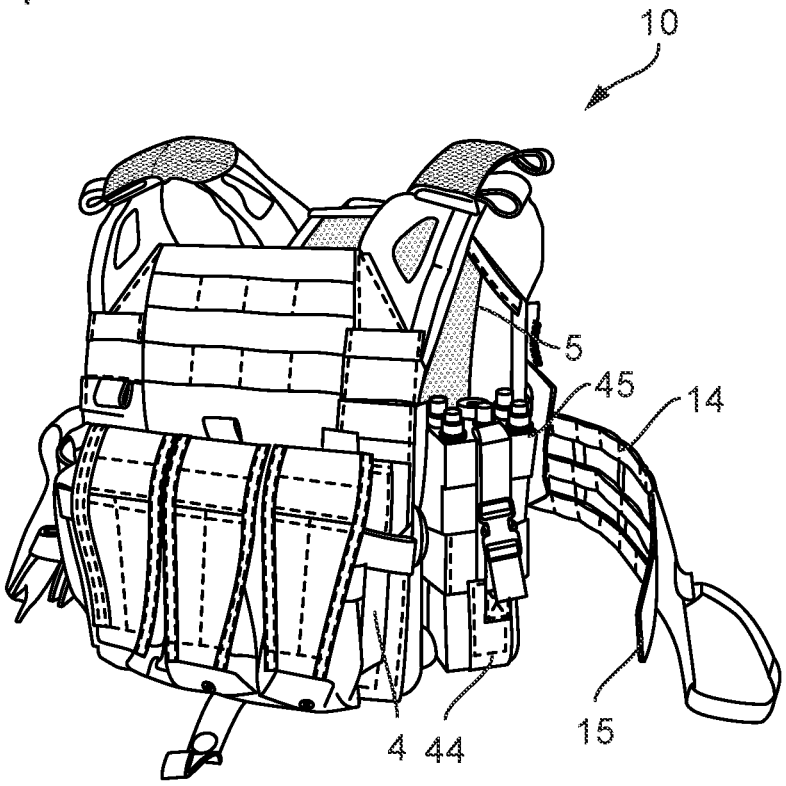
FIG. 8 shows an example of a load carrying assembly with a pouch attachment securely attached to the left side of a front section of the vest, wherein an accessory is present within the pouch section of the pouch attachment.

FIG. 7 shows the front of the load carrying assembly 10 with the vest 2 having the front section 4 and a rear section 5. The pouch attachment 40 is attached to the left side of the front section 4 of vest 2, with flap extension 42 secured inside of attachment pocket 6 of the front section 4. Cummerbund 14, when connected to the left side of front section 4, will enclose the attachment pocket 6 such that attachment pocket 6 is positioned on the inside of cummerbund 14 up against the torso of the person wearing the load carrying assembly 10. FIG. 8 shows an example of an accessory 45 secured inside of the pouch section 44 of pouch attachment 40.

Figure 9:
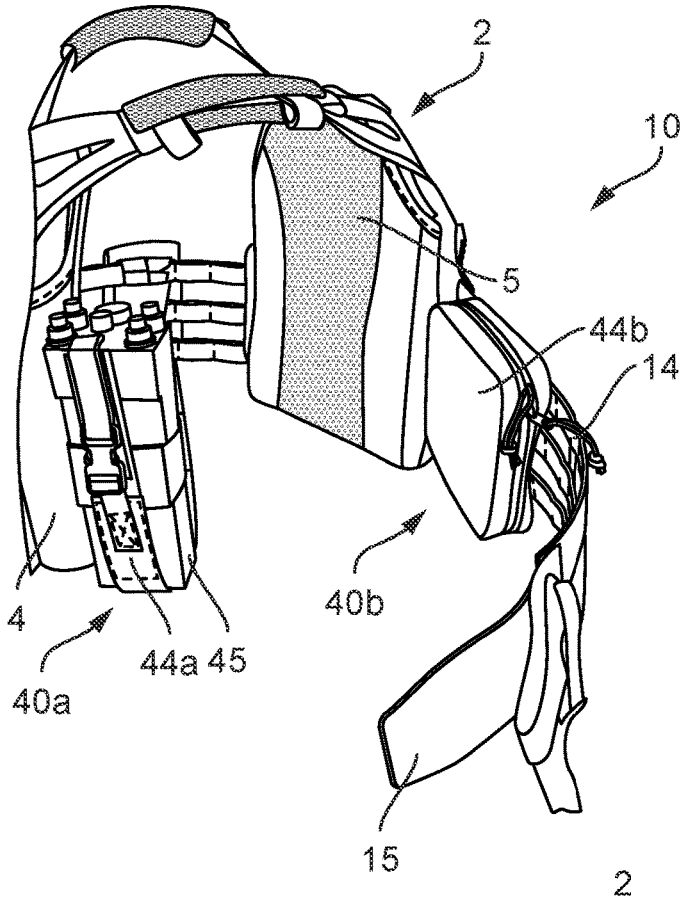
FIG. 9 shows an example of a portion of a load carrying assembly with a first pouch attachment attached to the left side of the front section of the vest and a second pouch attachment attached to the left side of the rear section of the vest, wherein the free end of the cummerbund is detached from the front section.

FIG. 9 shows the load carrying assembly 10 with cummerbund 14 in an open position. A first pouch attachment 40*a* is installed at the left side of front section 4, with the flap extension 42 of the first pouch attachment 40*a* being inserted into the attachment pocket 6 of the front section 4. As depicted, an accessory is secured within a first pouch section 44*a* of the first pouch attachment 40*a*. A second pouch attachment 40*b* is installed at the left side of rear section 5, with the flap extension 42 of the second pouch attachment 40*b* being inserted into the attachment pocket 6 of the rear section 5. As depicted, a second pouch section 44*b* of the second pouch attachment 40*b* is a zipper-closed pouch that may contain a variety of small items or accessories inside. As shown in FIG. 9, a free end 15 of cummerbund 14 may be a rigid extension that securely attaches inside a corresponding pocket (not shown) of the front section 4 of vest 2.

Figure 10:
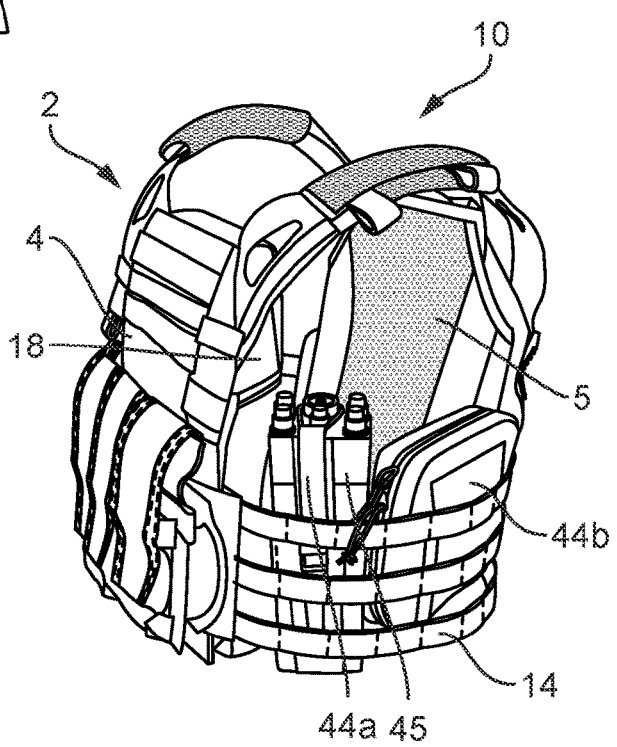
FIG. 10 shows an example of a portion of a load carrying assembly with a first pouch attachment attached to the left side of the front section of the vest and a second pouch attachment attached to the left side of the rear section of the vest, wherein the free end of the cummerbund is attached to the front section.

FIG. 10 shows the load carrying assembly 10 with cummerbund 14 in a closed position, wherein the free end 15 of cummerbund 14 is attached to the left side of front section 4. In this example, the first and second pouch attachments 40*a*, 40*b* are both positioned inside the cummerbund 14, and thus would be securely held against the torso of a user wearing the load carrying assembly 10. Placing accessories inside cummerbund 14 can reduce the chances of the accessories being snagged on external objects when a user wears the load carrying assembly 10. When a user detaches the free end 15 of cummerbund 14 in order to doff the load carrying assembly 10, the weight of the accessories secured with the first and second pouch sections 44*a*, 44*b* of the first and second pouch attachments 40*a*, 40*b* would be distributed close to the front section 4 and rear section 5, making it easier and safer to remove and maneuver the load carrying assembly 10. Additionally, the first and second pouch attachments 40*a*, 40*b* attached with flap extensions permit easy interchangeability of pouches (e.g., for different accessories) or moving of pouches to different locations on the load carrying assembly, while maintaining this superior load distribution.

The foregoing merely illustrates the principles of the disclosure. Any examples set forth in this specification are not intended to be limiting and merely set forth some of the many possible embodiments for the appended claims. Those skilled in the art will readily recognize various modifications and changes that may be made without following the example embodiments and applications illustrated and described herein, and without departing from the true spirit and scope of the following claims.

All references cited and/or discussed in this specification are incorporated herein by reference in their entireties and to the same extent as if each reference was individually incorporated by reference.

What is claimed is:

1. A load carrying assembly, comprising:

a vest comprising a front section, a rear section spaced rearwardly of the front section, and a left side section and a right side section that each extend between the front section and the rear section, wherein the front section and/or the rear section includes an attachment pocket, a fastener being positioned inside the attachment pocket; and a pouch attachment comprising a pouch section configured to hold an accessory, and a flap extension fixed to the pouch section and comprising another fastener, wherein the attachment pocket is configured to receive at least a portion of the flap extension, and the fastener of the flap extension is configured to securely attach to the fastener of the vest.

2. The load carrying assembly of claim 1, wherein:

the vest is configured to be worn on a torso of a user; and at least one of the left side section and the right side section of the vest is configured such that the pouch section is positioned between the at least one of the left side section and the right side section of the vest and is held against the torso of the user when the load carrying assembly is worn by the user and the at least a portion of the flap extension is positioned inside the attachment pocket.

3. The load carrying assembly of claim 1, comprising an attachment pocket having an opening provided at a left side of the front or rear section of the vest.

4. The load carrying assembly of claim 1, comprising an attachment pocket having an opening provided at a right side of the front or rear section of the vest.

5. The load carrying assembly of claim 1, wherein the fastener of the flap extension and the fastener of the vest comprise hook and loop.

6. The load carrying assembly of claim 1, wherein the flap extension has a length of about 2 inches to about 16 inches.

7. The load carrying assembly of claim 1, wherein the flap extension has a width of about 4 inches to about 18 inches.

8. The load carrying assembly of claim 1, wherein the front section of the vest further comprises an armor pocket, and the attachment pocket is configured to be positioned between the armor pocket and a torso of a user when the load carrying assembly is worn by the user.

9. The load carrying assembly of claim 1, wherein the left side section and the right side section comprise a cummerbund configured to attach to one or more accessories.

10. The load carrying assembly of claim 1, wherein a rear-facing surface of an inside portion of the attachment pocket comprises a fastener that aligns with and is configured to be secured to a corresponding fastener on a front-facing surface of an inside portion of the attachment pocket.

11. The load carrying assembly of claim 1, wherein the fastener provided on the flap extension occupies an area that is at least 30% of the total area of the flap extension.

12. The load carrying assembly of claim 1, wherein a width or length of the fastener provided on the flap extension extends at least 75% of the full width or length, respectively, of the flap extension.

13. A load carrying assembly, comprising:

a vest comprising a front section, a rear section spaced rearwardly of the front section, and a left side section and a right side section that each extend between the front section and the rear section, wherein a side of the front section and/or a side of the rear section is fixed to a flap extension comprising a fastener; and a pouch attachment comprising a pouch section configured to hold an accessory, wherein the pouch attachment comprises an attachment pocket and another fastener positioned inside the attachment pocket;

wherein the attachment pocket is configured to receive at least a portion of the flap extension, and the fastener of the flap extension is configured to securely attach to the fastener of the vest.

14. The load carrying assembly of claim 13, wherein the fastener of the flap extension and the fastener of the attachment pocket comprise hook and loop.

15. The load carrying assembly of claim 13, wherein the flap extension has a length of about 2 inches to about 16 inches.

16. The load carrying assembly of claim 13, wherein the flap extension has a width of about 4 inches to about 18 inches.

17. The load carrying assembly of claim 13, wherein the left side section and the right side section comprise a cummerbund configured to attach to one or more accessories.

18. The load carrying assembly of claim 13, wherein the fastener provided on the flap extension occupies an area that is at least 30% of the total area of the flap extension.

19. The load carrying assembly of claim 13, wherein a width or length of the fastener provided on the flap extension extends at least 75% of the full width or length, respectively, of the flap extension.

* * * * *